US007466933B2

(12) United States Patent
Furukawa

(10) Patent No.: US 7,466,933 B2
(45) Date of Patent: Dec. 16, 2008

(54) IMAGE FORMING APPARATUS IN WHICH REVERSE TRANSFER OF A DEVELOPING AGENT IS PREVENTED

(75) Inventor: Toshio Furukawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 380 days.

(21) Appl. No.: 11/275,534

(22) Filed: Jan. 12, 2006

(65) Prior Publication Data

US 2006/0159475 A1 Jul. 20, 2006

(30) Foreign Application Priority Data

Jan. 14, 2005 (JP) ..... 2005-007930

(51) Int. Cl.
*G03G 15/16* (2006.01)

(52) U.S. Cl. ..... 399/66

(58) Field of Classification Search ..... 399/66, 399/296, 297, 299, 300, 303, 306, 314
See application file for complete search history.

(56) References Cited

U.S. PATENT DOCUMENTS

| | | | | |
|---|---|---|---|---|
| 5,784,668 | A * | 7/1998 | Hyakutake et al. | 399/55 |
| 6,383,704 | B1 * | 5/2002 | Kataoka et al. | 430/108.6 |
| 6,421,508 | B2 * | 7/2002 | Inoue et al. | 399/44 |
| 6,445,899 | B2 | 9/2002 | Sato | |
| 6,507,724 | B2 * | 1/2003 | Tamura et al. | 399/297 |
| 6,529,693 | B2 | 3/2003 | Tomizawa et al. | |
| 6,564,021 | B1 * | 5/2003 | Nakai et al. | 399/49 |
| 6,694,119 | B2 | 2/2004 | Rokutanda et al. | |
| 7,215,898 | B2 * | 5/2007 | Nishiwaki et al. | 399/66 |

FOREIGN PATENT DOCUMENTS

| | | | |
|---|---|---|---|
| JP | 1992042177 | A | 2/1992 |
| JP | H07-098526 | A | 4/1995 |
| JP | H09-244437 | A | 9/1997 |
| JP | 2000-231234 | A | 8/2000 |
| JP | 2001166556 | A | 6/2001 |
| JP | 2003043783 | A | 2/2003 |
| JP | 2003262989 | A | 9/2003 |
| JP | 2004070251 | A | 3/2004 |
| JP | 2004151220 | A | 5/2004 |

OTHER PUBLICATIONS

Japanese Patent Office, Notification of Reasons for Refusal for Japanese Patent Application No. 2005-007930, dated Jul. 29, 2008 (partial translation). (Counterpart of above-captioned U.S. patent application).

* cited by examiner

*Primary Examiner*—Robert Beatty
(74) *Attorney, Agent, or Firm*—Baker Botts L.L.P.

(57) ABSTRACT

A color laser printer is configured to fulfill Qmin<Qs for suppressing occurrence of reverse transfer of toner. Qmin designates the minimum amount of transfer electric charge per unit area required to transfer a toner image of the maximum amount of toner onto a sheet (hereinafter referred to as a "per-unit-area required transfer electric charge level"). Qs designates the maximum amount of transfer electric charge per unit area which can prevent occurrence of reverse transfer (hereinafter referred to as an "transfer prevention per-unit-area electric charge level"). The transfer prevention per-unit-area electric charge level Qs is represented by $Qs=a/(Md)^2$. Md designates the maximum quantity of developing agent on a toner image per unit area thereof transferred onto a sheet immediately before being transferred, and "a" designates a proportional constant.

10 Claims, 8 Drawing Sheets

IMAGE FORMING APPARATUS IN WHICH REVERSE TRANSFER OF A DEVELOPING AGENT IS PREVENTED

CROSS REFERENCE TO RELATED APPLICATION

This application claims priority from Japanese Patent Application No. 2005-007930 filed on Jan. 14, 2005, the entire subject matter of which is incorporated herein by reference.

TECHNICAL FIELD

The present invention may relate to an electrophotographic image forming apparatus, and more particularly, to an image forming apparatus that forms a multicolor image by transferring images of a plurality of colors, the image being formed by a developing agent (hereinafter called "developing agent images") onto a transferred member in a superposed manner on a per-color basis.

BACKGROUND

An image forming apparatus hitherto known as an image forming apparatus for forming a multicolor image on a transferred member, such as a recording sheet or a transfer belt, is configured to uniformly electrify the surface of an image-carrying body, such as a photosensitive body, at a high voltage of predetermined polarity; to form an electrostatic latent image on the surface of the image-carrying body by means of exposing the surface of the electrified image carrier to the exposure unit; to form a toner image (the electrostatic latent image) by means of causing toner (a developing agent) of a predetermined color to adhere to the electrostatic latent image; and to transfer the toner image to a member to be transferred by use of transfer unit.

For example, a so-called tandem-type image forming apparatus having image-carrying bodies provided separately for individual colors is available as such an image forming apparatus which forms a multicolor image (see, e.g., JP-A-2001-166556).

The image forming apparatus of this type has a problem of occurrence of reverse transfer. Specifically, during the course of toner of a plurality of colors, which are charged with the same polarity (e.g., positive polarity) as that of a charged surface of an image-carrying body, being transferred to a transferred member through multi-transfer operation, a portion of the transferred toner is again reversely electrified (negatively electrified) and transferred back to the image-carrying body. When reverse transfer has arisen, the color balance of an image formed on the transferred member is lost, and there may arise a case where an image of a color, which is not intended by the user, is eventually formed.

SUMMARY

One aspect of the present invention may provide an image forming apparatus that forms a multicolor image and the occurrence of reverse transfer is prevented.

An image forming apparatus includes: an image carrier that is to be formed thereon an electrostatic latent image; an electrifying unit that electrifies a surface of the image carrier to a predetermined polarity; an exposure unit that exposes the surface of the image carrier electrified by the electrifying unit, in accordance with image data to form an electrostatic latent image; a development unit that develops the electrostatic latent image formed by the exposure unit with one of developing agents of a plurality of colors to form a developing agent image on the image carrier; a transport mechanism that transports a transferred member to be in contact with the image carrier, the transferred member being transferred to be formed thereon the developing agent image; and a transfer unit that transfers the developing agent image formed on the image carrier to the transferred member transported by the transport mechanism by applying transfer electric charges having polarity opposite an electrified polarity of the developing agent from a surface of the transferred member opposite a surface thereof opposing the image carrier. Te transfer unit forms a multicolor developing agent image on the transferred member by sequentially transferring the developing agent images of respective colors made from a plurality of the developing agents on the transferred member while the transport mechanism sequentially transporting the transferred member. When; among developing agent images of a plurality of colors to be transferred, a developing agent having already been transferred onto the transferred member is taken as a transferred developing agent image; and the maximum amount of transfer electric charge per unit area, at which reverse transfer of the transferred developing agent image onto the image carrier is prevented when a developing agent image of another color is transferred to the transferred member on which the transferred developing agent image is formed from developing agents of some colors of developing agents of a plurality of colors to be transferred, is taken as an amount of prevention per-unit-area transfer electric charge, an amount of required unit area transfer electric charge, which is an amount of transfer electric charge per unit area required by the transfer unit to transfer to the transferred member the maximum weight of developing agent image formed on the image carrier, becomes smaller than the weight of a prevention unit area transfer electric charge which is determined on the basis of an amount of developing agent per unit area on the transferred member that is the maximum weight of transferred developing agent image per unit area of achieved immediately before the transferred developing agent image is transferred by the transfer unit.

DETAILED DESCRIPTION

An illustrative aspects of the present invention will be described hereinbelow by reference to the drawings.

First Illustrative Aspect

Figure 1:
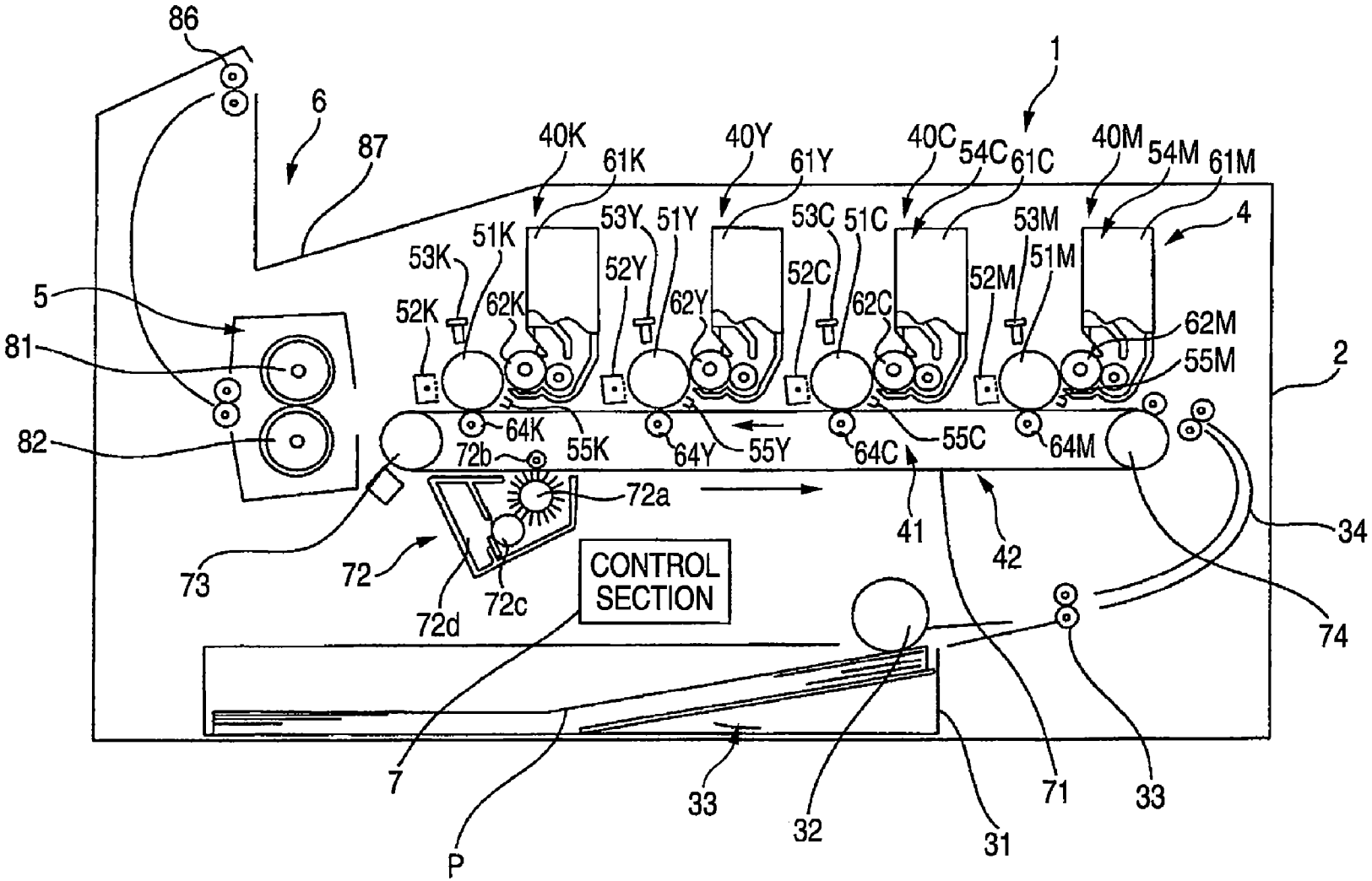
FIG. 1 is a side cross-sectional view showing the diagrammatic configuration of a color laser printer of a first illustrative aspect.

FIG. 1 is a side cross-sectional view showing the diagrammatic configuration of a color laser printer 1 according to a first illustrative aspect.

As shown in FIG. 1, the color laser printer (hereinafter simply called a "printer") 1 of the first illustrative aspect includes a housing 2 for housing pieces of equipment, and the like, constituting the printer 1; a sheet feeding section 3 for feeding a recording sheet P; an image forming section 4 for forming an image on the recording sheet P fed from the sheet feeding section 3; a fusing section 5 for fusing the image, which is formed on the recording sheet P by the image forming section 4, onto the recording sheet P; a sheet output section 6 for outputting the recording sheet P on which the image is fixed by the fusing section 5; and a control section 7 for controlling operation of the printer 1.

Of these pieces of equipment, the sheet feeding section 3 includes a sheet feeding tray 31 which is removably attached to a bottom section in the housing 2 and houses a plurality of recording sheets P in a stacked manner; a sheet feeding roller 32 which is provided at an elevated position above the sheet feeding tray 31 and which separately feeds the stacked recording sheets P one at a time; a transfer roller 33 which is provided downstream of the sheet feeding roller 32 with reference to a direction in which the recording sheet P is transported (hereinafter called a "transporting direction of the recording sheet P") and which transports the recording sheet P delivered by the sheet feeding roller 32; and a guide member 34 which guides the recording sheet P transported by the transport roller 33 to the image forming section 4.

Next, the image forming section 4 includes a transfer section 41 for transferring onto the recording sheet P images formed by respective image forming units 40; namely, a magenta image forming unit 40M which forms an image of magenta (M) color; a cyan image forming unit 40C which forms an image of cyan (C) color; a yellow image forming unit 40Y which forms an image of yellow (Y) color; and a black image forming unit 40K which forms an image of black (K) color. The image forming section 4 further includes a transport section 42 for sequentially transporting the recording sheet P to a location where an image is to be transferred onto the recording sheet.

The four image forming units 40M, 40C, 40Y, and 40K are horizontally arranged, in this sequence, from an upstream position toward a downstream position with reference to the transporting direction of the recording sheet P. The printer 1 is, in other words, a landscape tandem color laser printer.

Of these image forming units, the magenta image forming unit 40M has a photosensitive drum 51M for carrying an electrostatic latent image; an electrifying device 52M which is disposed around the photosensitive drum 51M and electrifies the photosensitive drum 5M; an exposure device 53M for forming an electrostatic latent image on the photosensitive drum 51M; a development unit 54M for causing a developing agent to adhere to the photosensitive drum 51M to thus form a developing agent image; and a static eliminating device 55M for reducing the amount of charges of the developing agent (i.e., a toner image) formed on the photosensitive drum 51M.

The photosensitive drum 51M is first formed from an essentially-cylindrical member and is provided in a rotatable manner. For instance, a substantially-cylindrical member to be used in the photosensitive drum 51M is made by forming a positively-charged photosensitive layer on a base material made of aluminum. This aluminum base material is connected to a ground line of the color laser printer 1.

Figure 2:
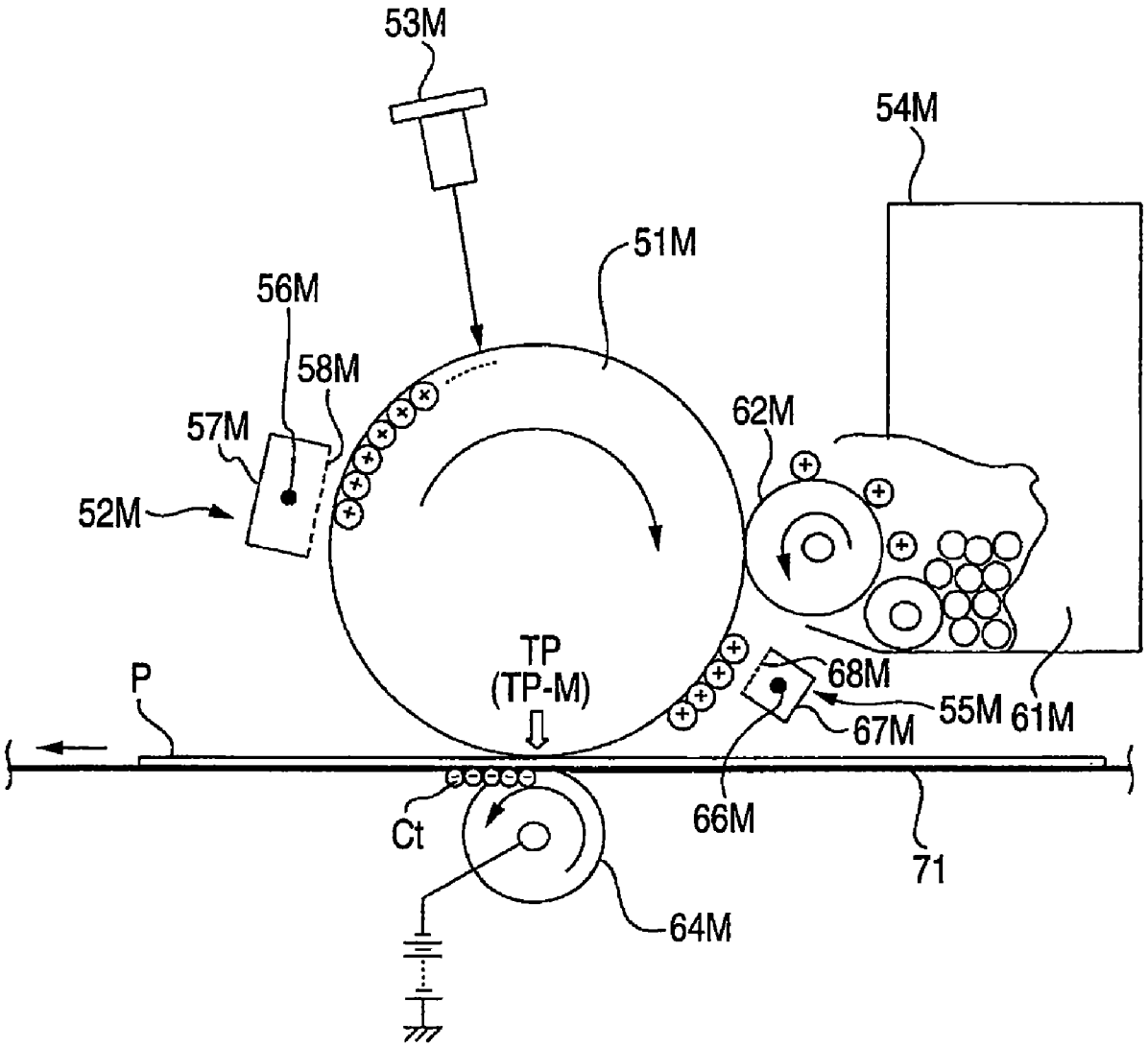
FIG. 2 is a diagrammatic schematic diagram showing the configuration of a neighborhood of a transfer nip section.

The electrifying device 52M is a so-called scorotron electrifying device. As shown in FIG. 2, the electrifying device 52M is formed from an electrifying wire 56M which is provided opposite the photosensitive drum 51M so as to extend in a widthwise direction thereof; a shield case 57M which houses the electrifying wire 56M and whose side facing the photosensitive drum 51M is opened; and a grid 58M formed in an opened portion of the shield case 57M.

When a high voltage is applied to the electrifying wire 56M and a constant voltage (e.g., +700V), which is lower than the voltage applied to the electrifying wire 56M, is applied to the grid 58M, the surface of the photosensitive drum 51M is charged to essentially the same potential level as the voltage of the grid 58M.

The exposure device 53M is disposed downstream of the electrifying device 52M with reference to the rotational direction (rightward rotation in the drawing) of the photosensitive drum 51M. The exposure device 53M emits, from the light source, a laser beam corresponding to the volume of exposure image data (which will be described later) of one color (magenta in the illustrative aspect) input from the control section 7. A mirror surface of a polygon mirror (omitted from the drawing), which is rotationally driven by a polygon motor (omitted from the drawing), radiates in a scanning manner the laser beam onto the surface of the photosensitive drum 51M.

As a result of the surface of the photosensitive drum 51M being exposed to the laser beam emitted from the exposure device 53M, the surface potential of the exposed portion decreases (to, e.g., +150V), whereupon an electrostatic latent image is formed on the surface of the photosensitive drum 51M.

The majority of the exposure device 53M shown in FIGS. 1 and 2 is omitted from the drawings. Only the portion of the exposure device that finally emits a laser bean is illustrated.

As shown in FIG. 2, the development unit 54M has a development unit case 61M for housing magenta toner, and a development roller 62M for supplying magenta toner to the surface of the electrified photosensitive drum 51M. Magenta toner housed in the development unit case 61M is a nonmagnetic one-component developing agent having a positive charging characteristic. There is used polymer toner which is formed by copolymerization of polymeric monomer; e.g., styrene-based monomer such as styrene, acrylic monomer such as an acrylic acid, alkyl (C1 to C4) acrylate, or alkyl (C1 to C4) meta-acrylate, by means of a known polymerization method such as suspension polymerization. The polymer toner assumes an essentially spherical shape and exhibits superior fluidity. Since such toner exhibits extremely superior fluidity, the toner is well transferred from the photosensitive drum (the image carrier) to a recording sheet (the transferred member). Therefore, the amount of toner remaining on the image carrier after transfer can be considerably reduced. Moreover, since toner assumes a spherical shape, physical adhesion (van der Waals force or the like) is reduced, so that the amount of reverse transfer can be suppressed.

Of the development rollers, the development roller 62M is formed from a base material, such as conductive silicone rubber, into a columnar shape. Fluorine-containing resin, or a coating layer of rubber material, is formed on the surface of the development roller 62M. The development roller 62M is also disposed downstream of the exposure device 53M with reference to the rotational direction of the photosensitive drum 51M so as to become adjacent to the photosensitive drum 51M. A development bias (e.g., +400V) is applied to the development roller 62M.

The development unit 54M positively electrifies toner (with positive polarity), and supplies the toner as a uniform thin layer to the development roller 62M. Moreover, in a nipping section between the development roller 62M and the photosensitive drum 51M, the development unit 54M develops the positive electrostatic latent image (with positive polarity) formed on the photosensitive drum 51M with the positively-electrified toner (with positive polarity) through reversal development, to thus form a toner image.

The development unit 54M adopts a so-called cleanerless system, wherein, after the transfer device 64M (which will be described later) has transferred the toner image onto the recording sheet P, the development roller 62M recovers the toner still remaining on the surface of the photosensitive drum 51M.

The static eliminating device 55M is formed from an electrifying wire 66M which is provided opposite the photosensitive drum 51M so as to extend in the widthwise direction thereof; a shield case 67M which houses the electrifying wire 66M and whose side facing the photosensitive drum 51M is opened; and a grid 68M provided in the opened section of the shield case 67M.

A voltage, whose polarity (e.g., negative polarity) is opposite the electrified polarity (i.e., positive polarity in the illustrative aspect) of the developing agent formed on the photosensitive drum 51M, is applied to the electrifying wire 66M by means of so-called constant current control (e.g., −100 μA). In order to satisfy the reverse transfer prevention relational expression (which will be described later), a predetermined constant voltage (e.g., +250V in the illustrative aspect) is applied to the grid 68M. Thereby, the surface of the developing agent formed on the photosensitive drum 51M is maintained at essentially the same potential level as the voltage of the grid 68M.

As shown in FIG. 1, the cyan image forming unit 40C (the yellow image forming unit 40Y, the black image forming unit 40K) has a photosensitive drum 51C (51Y, 51K), an electrifying device 53C (52Y, 52K), an exposure device 53C (53Y, 53K), a development unit 54C (54Y, 54K), and a static eliminating device 55C (55Y, 55K)

Specifically, the cyan image forming unit 40C (the yellow image forming unit 40Y, the black image forming unit 40K) is identical with the magenta image forming unit 40M, except that cyan (yellow, black) toner is stored in the development unit 54C (54Y, 54K).

The transport section 42 has a sheet transport belt 71 for horizontally transporting the recording sheet P supplied from the sheet feeding section 3, and a developing agent recovery device 72 which is disposed downstream of the black image forming unit 40K with reference to the sheet transporting direction and recovers the developing agent adhering to the surface of the sheet transport belt 71.

Of these components, the sheet transport belt 71 is narrower in width than the photosensitive drums 51M, 51C, 51Y, and 51K and is formed endlessly so as to travel integrally with the recording sheet P placed on the upper surface of the belt 71. The sheet transport belt 71 is passed around a drive roller 73 and the driven roller 74.

By means of such a configuration, the surface (hereinafter referred to as a "sheet transport belt surface") of the sheet transport belt 71 opposing the photosensitive drums 51M, 51C, 51Y, and 51K is moved from right to left in the drawing by means of rotation of the drive roller 73, as shown in FIG. 1. Specifically, the sheet transport belt 71 delivers the recording sheet P fed from the sheet feeding section 3 to the fusing section 5 by means of sequentially transporting the sheet between the photosensitive drums 51M, 51C, 51Y, 51K and the surface of the sheet transport belt.

The developing agent recovery device 72 has a cleaning brush 72*a* for sucking the toner adhering to the surface of the sheet transport belt; an electrode roller 72*b* provided in a position opposing the cleaning brush 72*a* with the sheet transport belt 71 sandwiched therebetween; a recovery roller 72*c* for removing the toner adhering to the cleaning brush 72*a* from the same; and a storage box 72*d* for storing the toner removed from the cleaning brush 72*a* by the recovery roller 72*c*.

The cleaning brush 72*a* is formed in such a manner that a brush is provided around an substantially-cylindrical member extending in the widthwise direction (hereinafter called a "belt width direction") of the sheet transport belt 71. The cleaning brush 72*a* is provided such that a bias voltage, which causes a predetermined potential to develop between the electrode roller 72*b* and the cleaning brush 72*a*, is applied to the cleaning brush 72*a*, and that the cleaning brush 72*a* rotates while remaining in contact with the sheet transport belt 71.

Thus, an electric field develops between the cleaning brush 72*a* and the electrode roller 72*b*. The toner adhering to the surface of the sheet transport belt is moved by the electric field in a direction toward the cleaning brush 72*a*, whereby the toner is adsorbed by the cleaning brush 72*a*.

Next, the transfer section 41 has a transfer roller 64M (64C, 64Y, 64K) which is to be disposed opposite the photosensitive drum 51M (51C, 51Y, 51K) on the opposite side of the development unit 54M (54C, 54Y, 54K) with the sheet transport belt 71 sandwiched therebetween.

A transfer voltage, whose polarity (negative polarity) is opposite the polarity (positive polarity in the illustrative aspect) by means of which the electrifying device 52M (52C, 52Y, 52K) electrifies the photosensitive drum 51M (51C, 51Y, 51K), is applied from the unillustrated light source to the transfer roller 64M (64C, 64Y, 64K) of the above transfer rollers, such that a transfer current of a given electrical current value satisfying Equation (5), which will be described later, flows into the transfer roller 64M (64C, 64Y, 64K) (so-called constant current control operation).

By means of this control operation, an appropriate transfer bias is applied between the transfer roller 64M (64C, 64Y, 64K) and the photosensitive drum 51M (51C, 51Y, 51K). Negative electric charges (hereinafter referred to as "transfer electric charges") Ct are supplied to a portion of the sheet transport belt 71, which comes into contact with the transfer roller 64 (i.e., the back of the sheet transport belt 71).

The fusing section 5 is formed from a heating roller 81 which serves as a heating body; and a pressure roller 82 which is disposed opposite the heating roller 81 with the transport path of the recording sheet P interposed therebetween and which comes into compressed contact with the heating roller 81. Thereby, the fusing section 5 undergoes heating and pressurization while transporting the recording sheet P, which carries a multicolor image formed from toner images of four colors, in a nipped manner by the heating roller 81 and the pressure roller 82, to thus fix the multicolor image on the recording sheet P.

The sheet output section 6 includes a pair of sheet output rollers 86 for transporting the recording sheet P onto which the fusing section 5 has finished fusing the images; and a sheet output tray 87 which is disposed downstream of the sheet output roller 86 and stores the recorded sheets P having undergone all image forming processes.

Figure 3:
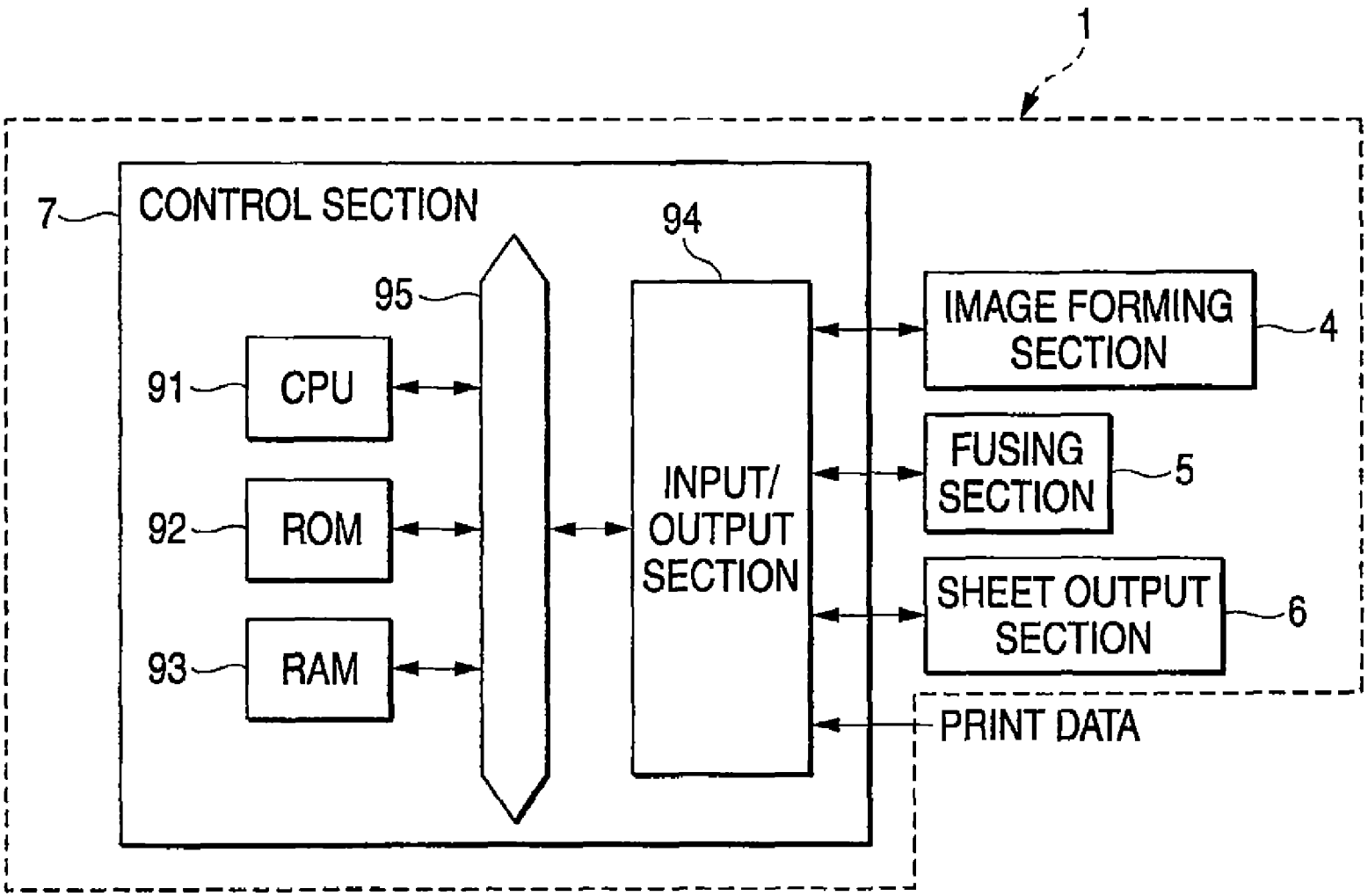
FIG. 3 is a block diagram showing an electrical configuration of the color laser printer.

FIG. 3 is a block diagram showing an electrical configuration of the printer 1.

As shown in FIG. 3, the printer 1 is built of the above-described image forming section 4, the fusing section 5, the sheet output section 6, and the control section 7.

Of these components, the control section 7 is formed from a CPU 91 which executes processing in accordance with a predetermined processing program, ROM 92 storing various control programs; RAM 93 storing pieces of data of various types; the image forming section 4; and an input/output section 94 which is connected to the fusing section 5 and the sheet output section 6 and exchanges a signal and data with the CPU 91 and the RAM 95. The CPU 91, the ROM 92, the RAM 93, and the input/output section 94 are connected by way of a bus 95.

Print data used for forming an image on the recording sheet P are input to the input/output section 94 from the outside of the printer 1.

In the control section 7 configured as mentioned above, the CPU 91 performs image data generation processing for generating exposure image data used for causing the exposure devices 53 (53M, 53C, 53Y, 53K) to effect exposure on the basis of the print data input from the outside, the static eliminating device operation determination processing for determining enable/disable of operation of the static eliminating devices 55 (55M, 55C, 55Y, 55K).

Figure 4:
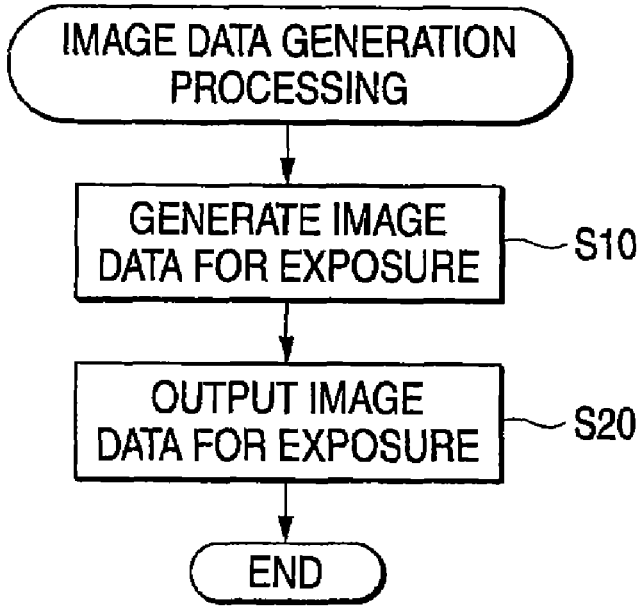
FIG. 4 is a flowchart showing procedures of image data generation processing.

Image data generation processing will now be described by reference to FIG. 4. FIG. 4 is a flowchart showing image data generation processing. Image data generation processing is processing to be initiated at a point in time when print data are input to the control section 7.

When image data generation processing has been commenced, the CPU 91 generates exposure image data in S10. Specifically, there are generated magenta exposure image data used for causing the exposure device 53M to emit a laser beam corresponding to the input print data; cyan exposure image data used for causing the exposure device 53M to emit the laser beam; yellow exposure image data used for causing the exposure device 53Y to emit the laser beam; and black exposure image data used for causing the exposure device 53K to emit the laser beam.

Figure 7A:
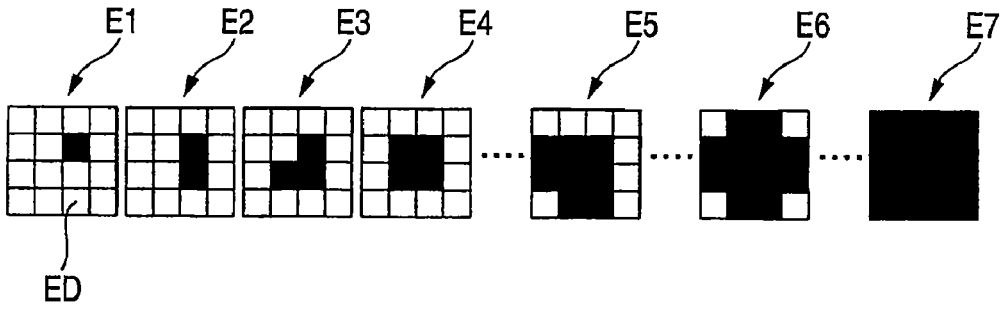
FIGS. 7A-7C are views for describing a relationship between image data for exposure, the amount of reverse transfer, and a transfer current, and a relationship between the amount of electric charges of toner and the number of copies.

As shown in FIG. 7A, one pixel of the print data corresponds to exposure dots ED numbering 4 (vertical)×4 (horizontal)=16 in the exposure image data. (Solid squares denote areas in the drawing that are exposed to a laser.) In the sixteen exposure dots ED of a single pixel, the greater the number of dots to be exposed to a laser, the greater the print area of one pixel (an area to be developed). For instance, as shown in FIG. 7A, the area of one pixel increases in sequence of Pixel E1→Pixel E2→Pixel E3→Pixel E4→ . . . →Pixel E5→ . . . →Pixel E6→ . . . →Pixel E7.

When processing pertaining to S10 is completed, in S20 the four types of exposure image data generated in S10 are output to the corresponding exposure devices 53 (53M, 53C, 53Y, 53K). Image data generation processing is completed. Thus, the exposure devices 53 perform exposure operation in accordance with exposure image data.

Figure 5:
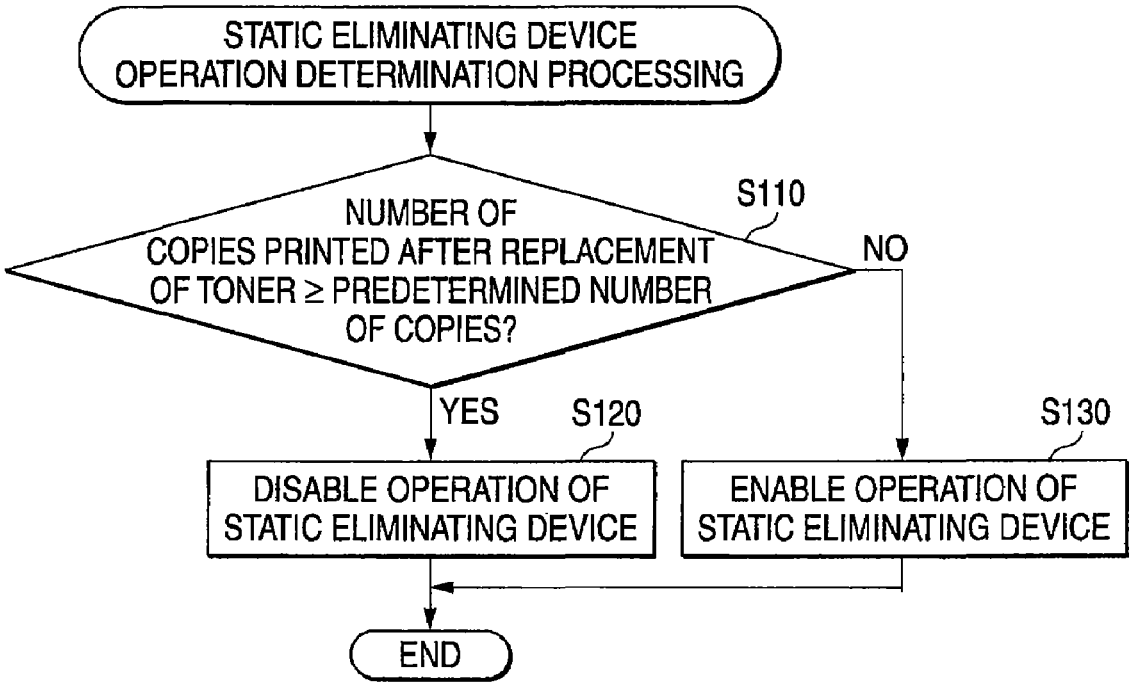
FIG. 5 is a flowchart showing procedures of static eliminating device operation determination processing.

Static eliminating device operation determination processing will be described by reference to FIG. 5. FIG. 5 is a flowchart showing static eliminating operation determination processing. Static eliminating operation determination processing is initiated at a point in time when image forming operation of the printer 1 has been completed (or at a point in time when image forming operation of the printer 1 is started).

When a static eliminating device operation determination processing is commenced, the CPU 91 determines, in S110, whether or not printing of a predetermined number of copies (e.g., 3000 copies in the present illustrative aspect) or more has been performed following replacement of toner of the development units 54 (54M, 54C, 54Y, 54K).

Figure 7B:
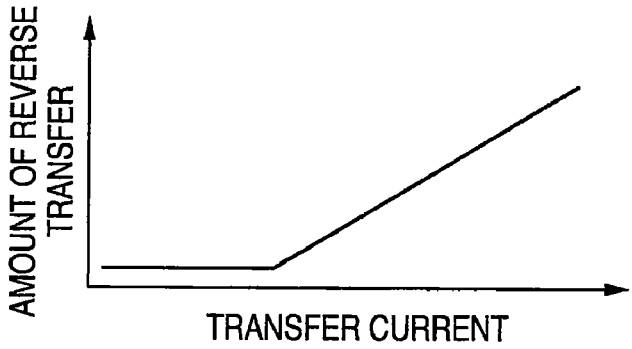
Figure 7C:
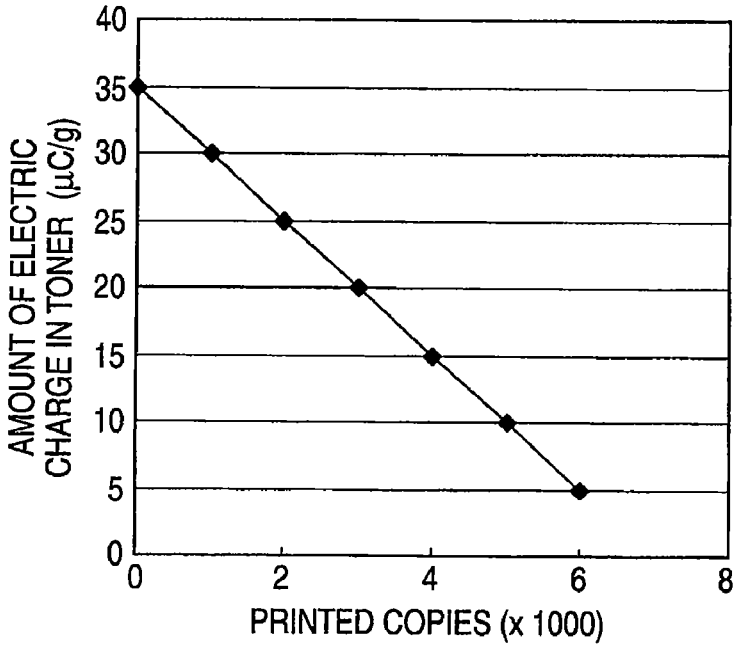

As shown in FIG. 7C, toner generally has a nature such that a decrease in the amount of electric charges becoming larger as the printer storing the toner performs printing operation to a greater extent. Specifically, even when the static eliminating device 55 is not operated, a predetermined number of copies is set to the number of copies which are required for the amount of electric charges in toner to assume a value fulfilling the reverse transfer prevention relation expression (which will be described later).

When printing of a predetermined number of copies or more has been performed (YES in S110), operation of the static eliminating devices 55 is disabled, and static eliminating operation determination processing is completed. Thus, the static eliminating devices 55 do not operate during image forming operation of the printer 1.

When printing of a predetermined number of copies or more has not yet been performed (NO in S110), the static eliminating devices 55 are released from the disabled state in S130, and static eliminating operation determination processing is completed. Thus, the static eliminating 55 operate during image forming operation of the printer 1.

An accurate mechanism of occurrence of reverse transfer has not yet been explained. Repeated examination of a cause of reverse transfer; more specifically, a cause of toner being reversely electrified, has led to one inference. First, reverse electrification is caused by electric discharge in a toner layer transferred onto a print sheet. Discharge in the toner layer is induced by a strong electric field developing between toner and a print sheet. When toner of respective colors is sequentially transferred, toner transferred onto the print sheet also becomes multilayered. Accordingly, the overall electric potential of toner is increased by the electric charges and electrostatic capacitance of the toner layer. In association with an increase in electric potential, electric discharge arises in the toner layers, and toner of upper layers is reversely electrified to negative polarity.

For instance, as shown in FIG. 1, when toner images (with positive polarity) on the photosensitive drums 51M, 51C, 51Y, 51K are transferred at a transfer nip section TP, where the photosensitive drums 51M, 51C, 51Y, 51K oppose the transfer rollers 64M, 64C, 64Y, and 64K, an electric discharge develops under influence of the electric charges of toner in the positive toner images transferred onto the print sheet P to be transported leftward in the drawing by the sheet transport belt 71, so that a reversely-electrified toner image whose upper layer portion is electrified reversely (negatively) to normal electrification polarity is generated. Even if reverse elelectrification fails to raise even after the print sheet has passed by the transfer nip section TP, there may arise a chance of reverse electrification occurring when a sheet of the next color enters the transfer position during transfer of the next color. The reason for this is that, as a result of electric charges being applied to toner from the photosensitive drum during transfer operation, the amount of electric charges (potential) of the toner image increases. However, there is a tendency of electric discharge and reverse electrification developing easily as the amount of electrified charges of the toner image becomes greater. By means of addition of a transfer bias, electric discharge arises more easily. The test results can be explained well by means of such a concept.

In the image forming apparatus where development is performed sequentially by the four development units 54M, 54C, 54Y, 54K—assigned to four colors—as in the case of the present illustrative aspect, when toner is stacked up to, e.g., only two layers, the cyan toner stacked by the development unit 54C—second in sequence of formation of a toner image—on magenta toner laid on the print sheet P by the development unit 54M—first in sequence of formation of a toner image—is reversely transferred to the development unit 54Y, which is third in sequence of formation of a toner image. Cyan toner stacked by the second development unit 54C on magenta toner laid by the first development unit 54M and yellow toner stacked by the third development unit 54Y on cyan toner laid by the first development unit 54M, or yellow toner stacked by the third development unit 54Y on cyan toner laid by the second development unit 54C are reversely transferred onto the development unit 54K which is the fourth. Of these toner layers, yellow toner of the third layer stacked on the first layer of magenta toner is found to be reversely transferred in the largest amount to the fourth development unit 54K. The second layer of cyan toner stacked on the first layer of magenta toner is found to be transferred in the second largest amount to the fourth development unit 54K. Namely, tests and the like reveal that the great majority of reverse transfer arises in the two layers of toner including a first color, and that toner stacked in a higher position is more liable to reverse transfer.

Therefore, the color laser printer 1 of the present illustrative aspect is configured to satisfy Equation (1) provided below in order to prevent reverse transfer of toner from the recording sheet P to the photosensitive drum 51.

$$Qmin<Qs \quad (1)$$

Here, Qmin designates the minimum amount of transfer electric charge per unit area required to transfer a toner image of the maximum amount of toner formed on the photosensitive drum 51 onto the recording sheet P (hereinafter referred to as a "per-unit-area required transfer electric charge level").

Qs designates the maximum amount of transfer electric charge Ct per unit area which can prevent occurrence of reverse transfer (hereinafter referred to as a "transfer prevention per-unit-area electric charge level").

Equation (1) is hereinafter also called a reverse transfer prevention relational equation.

The transfer prevention per-unit-area electric charge level Qs is represented by Equation (2) provided below.

$$Qs=a/(Md)^2 \quad (2)$$

The per-unit-area required transfer electric charge level Qmin is represented by Equation (4) provided below.

$$Qmin=M1\times Q1+M2\times Q2+M3\times Q3+M4\times Q4 \quad (4)$$

Namely, the transfer prevention per-unit-area electric charge level Qs is inversely proportional to the square of a developing agent quantity per-unit-area-of-transfer-member Md.

Here, Md designates the maximum quantity of developing agent on a toner image per unit area thereof transferred onto the recording sheet P immediately before being transferred by the transfer roller 64 (hereinafter referred to as "quantity-of-developing-agent-per-unit-area-on-transfer-member")

Further, "a" designates a predetermined constant which represents a relationship between the transfer prevention per-unit-area electric charge level Qs and the quantity-of-developing-agent-per-unit-area-on-transfer-member Md. The predetermined constant "a" assumes a value of 0.068 provided that the unit of the per-unit-area required transfer electric charge level Qmin is taken as ($C/m^2$) and the unit of the quantity-of-developing-agent-per-unit-area-on-transfer-member Md is taken as ($g/m^2$).

M1 designate the maximum per-unit-area weight of a magenta toner image transferred onto the recording sheet P; M2 designates the maximum per-unit-area weight of a cyan toner image transferred onto the recording sheet P; M3 the maximum per-unit-area weight of a yellow toner image transferred onto the recording sheet P; and M4 the maximum per-unit-area weight of a black toner image transferred onto the recording sheet P. Hereinafter, M1 is also called a per-unit-area maximum-weight-of-transferred-magenta; M2 is also called a per-unit-area maximum-weight-of-transferred-cyan; M3 is also called a per-unit-area maximum-weight-of-transferred-yellow; and M4 is also called a per-unit-area maximum-weight-of-transferred-black.

Q1 designates the per-unit amount of electric charge in magenta toner transferred onto the recording sheet P; Q2 designates the per-unit amount of electric charge in cyan toner transferred onto the recording sheet P; Q3 designates the per-unit amount of electric charge in yellow toner transferred onto the recording sheet P; and Q4 designates the per-unit amount of electric charge in black toner transferred onto the recording sheet P. Q1 is hereinafter also called an electric-charge-level-in-per-unit-weight-of-magenta; Q2 is hereinafter also called an electric-charge-level-in-per-unit-weight-of-cyan; Q3 is hereinafter also called an electric-charge-level-in-per-unit-weight-of-yellow; and Q4 is hereinafter also called an electric-charge-level-in-per-unit-weight-of-black.

Provided that the amount of electric charge per unit area (hereinafter referred to as an "supplied transfer electric charge level") pertaining to the transfer electric charge Ct supplied to the back of the sheet transport belt 71 by each of the transfer rollers 64 is Qt, a transfer current flowing through the respective transfer rollers 64 is set such that the supplied transfer electric charge level Qt fulfilling Equation (5) provided below is supplied.

$$Qmin<Qt<Qs \quad (5)$$

Namely, increasing the supplied transfer electric charge level Qt to greater than the per-unit-area required transfer electric charge level Qmin (Qmin<Qt) shows that, even when a toner image of the maximum amount of toner is formed on the photosensitive drum 51, the overall toner image can be transferred onto the recording sheet P. Further, decreasing the supplied transfer electric charge level Qt so as to become smaller than the transfer prevention per-unit-area electric charge level Qs (Qt<Qs) shows that reverse transfer can be prevented.

The inventor has found, by experiment, that a relationship represented by Equation (2) exists between the transfer prevention per-unit-area electric charge level Qs and the quantity-of-developing-agent-per-unit-area-on-transfer-member Md. Specifics of the experiment will now be described.

Conditions for the experiment as follows. Here, the experiment is intended for a case where yellow toner, which is the third color, is laid over magenta toner, which is the first color, and is reversely transferred in the largest quantity.

Measurement was performed by use of a tandem color laser printer of direct transfer type which transfers a toner image on a recording sheet in sequence of magenta (M)→cyan (C)→yellow (Y)→black (K).

Transfer of toner images was performed such that the quantity of magenta (M) toner that adheres and the quantity of yellow (Y) toner that adheres become equal to each other. Subsequently, a transfer current value, which indicates that reverse transfer is about to arise during transfer of black (K) toner, was measured.

Print speed: 118 mm/s

Width of Transfer Roller: 222 mm

Total amount of magenta (M) toner and yellow (Y) toner adhering (hereinafter also called "Total quantity of adhering MY"): 0.6 mg/cm$^2$, 0.7 mg/cm$^2$, 0.8 mg/cm$^2$, 0.9 mg/cm$^2$, 1.0 mg/cm$^2$ (e.g., when the total amount of adhering MY toner is 0.6 mg/cm$^2$, 0.3 mg/cm$^2$ of magenta (M) toner and 0.3 mg/cm$^2$ of yellow (Y) toner adhered to the recording sheet).

As shown in FIG. 7B, when the transfer current has become greater than a certain value (threshold value), the amount of reversely-transferred toner is known to abruptly become greater. Accordingly, in the present experiment, the threshold value was taken as a transfer current value at which reverse transfer is about to start (hereinafter called a "reverse transfer start current value"), and the threshold value was measured for each total quantity of adhering MY toner.

Figure 6A:
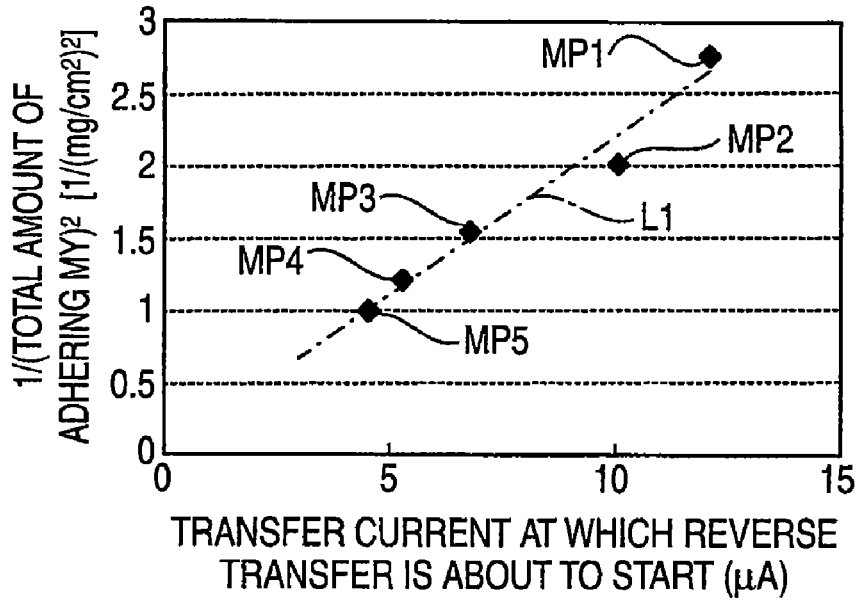
FIGS. 6A and 6B are graphs showing a reverse transfer prevention relational expression.

Measurement was performed under the above conditions for experiment, whereby a graph shown in FIG. 6A was obtained. In a graph shown in FIG. 6A, measurement points MP1, MP2, MP3, MP4, and MP5 designate transfer current values (hereinafter called "reverse transfer start current values") at which reverse transfer is about to start at a total quantity of adhering MY toner of: 0.6 mg/cm$^2$, 0.7 mg/cm$^2$, 0.8 mg/cm$^2$, 0.9 mg/cm$^2$, and 1.0 mg/cm$^2$.

From the graph shown in FIG. 6A, a proportional relationship is found to exist between "1/(a square of total amount of adhering MY) and the reverse transfer start current value (see straight line L1 in the graph). Specifically, the reverse transfer start current value is inversely proportional to the square of the total quantity of adhering MY toner.

Figure 6B:
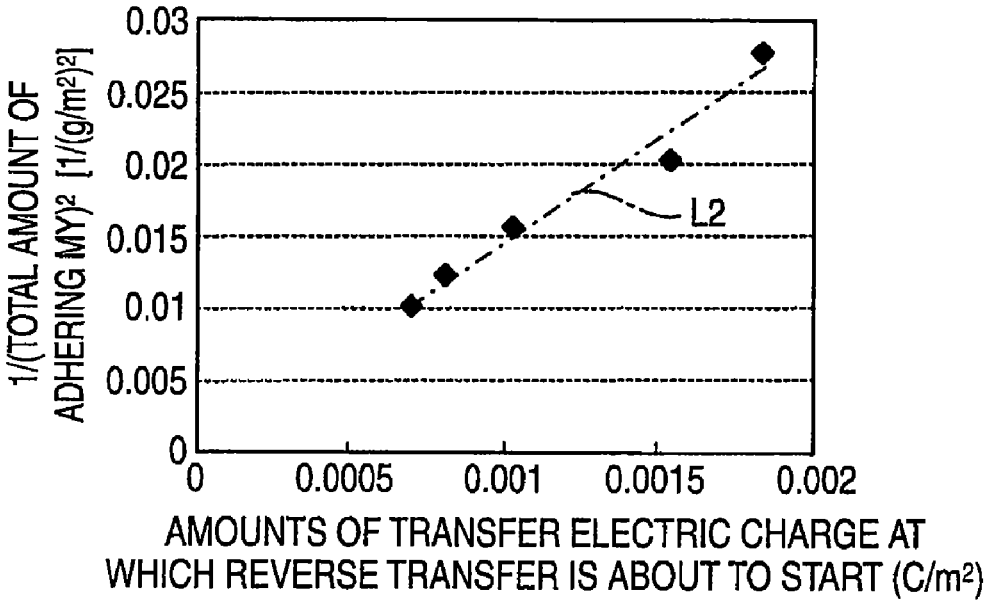

Further, when the reverse rotation start current value is replaced with the quantity of transfer electric charge per unit area at which reverse transfer is about to arise (hereinafter called a "reverse transfer start electric charge level") on the basis of the print speed and the width of the transfer roller, a graph shown in FIG. 6B is obtained.

The graph in FIG. 6B reveals that a proportional relationship exists between "1/(a square of the total amount of adhering MY toner)" and the reverse transfer start electric charge level (see straight line L2 in the graph). Namely, the reverse transfer start electric charge level is inversely proportional to the square of the total quantity of adhering MY toner.

The following relational expression is obtained by computing the slope of straight line L2.

(Reverse transfer start electric charge level)=0.068×{1/(square of the total quantity of adhering *MY* toner)}

In the above expression, the unit of reverse transfer start electric charge level is [C/m$^2$], and the unit of the total amount of adhering MY toner is [g/m$^2$].

The reverse transfer prevention relational expression is described hereunder by means of providing specific values in the following first to third examples.

First, basic print conditions common among the first to third examples when the colors are printed on the recording sheet P such that the amount of adhering magenta (M) toner and the amount of adhering yellow (Y) toner become equal to each other in the printer 1. Subsequently, black (K) toner is printed on the recording sheet P.

The quantity of magenta (M) toner adhering to the recording sheet P and the quantity of yellow (Y) toner adhering to the recording sheet P assume a value of 0.6 mg/cm$^2$, respectively.

The value of reverse rotation prevention relational expression achieved during printing of black (K) toner is provided.

FIRST EXAMPLE

When the electric-charge-level-in-per-unit-weight-of-magenta Q1, the electric-charge-level-in-per-unit-weight-of-cyan Q2, the electric-charge-level-in-per-unit-weight-of-yellow Q3, and the electric-charge-level-in-per-unit-weight-of-black Q4 assume a value of 0.050 μC/mg, the following products are derived: namely, M1×Q1=0.6×0.050=0.03 [μC/cm$^2$]; M2×Q2=0.03 [μC/cm$^2$]; M3×Q3=0.03 [μC/cm$^2$]; and M4×Q4=0.03 [μC/cm$^2$]. In short, the per-unit-area required transfer electric charge level Qmin=0.12 [μC/cm$^2$]. Specifically, the per-unit-area required transfer electric charge level Qmin is computed as Qmin=0.12 [μC/cm$^2$] by use of Equation (4).

Magenta (M) toner and yellow (Y) toner adhere to the recording sheet P, and hence the transfer prevention per-unit-area electric charge level Qs is computed as Qs=0.068/(0.6+0.6)$^2$=0.047 [μC/cm$^2$] by use of Equation (2).

Accordingly, there is derived Qmin>Qs; namely, the reverse transfer prevention relational expression is not fulfilled.

SECOND EXAMPLE

When the electric-charge-level-in-per-unit-weight-of-magenta Q1, the electric-charge-level-in-per-unit-weight-of-cyan Q2, the electric-charge-level-in-per-unit-weight-of-yellow Q3, and the electric-charge-level-in-per-unit-weight-of-black Q4 assume a value of 0.0195 μC/mg, the following products are derived: namely, M1×Q1×M2×Q2=M3×Q3=M4×Q4=0.6×0.0195=0.0117[μC/cm$^2$]. In short, the per-unit-area required transfer electric charge level Qmin is computed as Qmin=0.0468 [μC/cm$^2$] by use of Equation (4).

As in the case of the first example, the transfer prevention per-unit-area electric charge level Qs is computed as Qs=0.068/(0.6+0.6)$^2$=0.047 [μC/cm$^2$].

Accordingly, Qmin(=0.0468)<Qs(=0.047) is derived. Namely, the reverse transfer prevention relational expression is fulfilled.

THIRD EXAMPLE

When the electric-charge-level-in-per-unit-weight-of-magenta Q1, the electric-charge-level-in-per-unit-weight-of-cyan Q2, the electric-charge-level-in-per-unit-weight-of-yellow Q3, and the electric-charge-level-in-per-unit-weight-of-black Q4 assume a value of 0.015 μC/mg, the following products are derived; namely, M1×Q1=M2×Q2=M3×Q3=M4×Q4=0.6×0.015=0.009 [μC/cm$^2$]. In short, the per-unit-area required transfer electric charge level Qmin is computed as Qmin=0.036 [μC/cm$^2$] by use of Equation (4).

As in the case of the first example, the transfer prevention per-unit-area electric charge level Qs is computed as Qs=0.068/(0.6+0.6)$^2$=0.047 [μC/m$^2$].

Accordingly, Qmin(=0.036)<Qs(=0.047) is derived. Namely, the reverse transfer prevention relational expression is fulfilled.

In the second and the third examples that have been described above, the per-unit-weight electric charge levels Q1 to Q4 are reduced to 0.0195 μC/mg or less, whereby a reverse transfer prevention relational expression can be fulfilled.

In the printer 1 of the present illustrative aspect configured as mentioned above, one recording sheet P is first fed from the sheet feeding section 3 to the sheet feeding roller 32, and the sheet is then delivered to the sheet transport belt 71 by way of the transfer roller 33 and the guide member 34.

The surface of the (first color) photosensitive drum 51M that is located in the rightmost position in FIG. 1 was uniformly electrified at +700V by means of the electrifying device 52M and exposed by the exposure 54M in accordance with data corresponding to magenta of the image data input from the control section 7. Thereby, the potential of an exposed area decreased to a potential of about +150 V, whereby an electrostatic latent image was formed. Next, positively-electrified magenta toner was supplied to the surface of the photosensitive drum 51M from the development roller 62M, to which the development bias (+400V) was applied by the development unit 54M. Thereby, the electrostatic latent image on the surface of the photosensitive drum 51M was formed, and magenta toner adhered to only the area whose electric potential had become lower than the development bias, to thus develop the electrostatic latent image. Thus, a magenta toner image was formed. Subsequently, the electrostatic charge of the magenta toner image formed on the photosensitive drum 51M was eliminated by the static eliminating device 55M, whereby the photosensitive drum 51M assumed essentially the same electric potential as the voltage (+250V) of the grid 68M.

The range of electric potential of the toner image required to fulfill the relationship of Qmin<Qs can be computed to a certain extent by the following relationship.

$$(Vt-VL)\times C\approx Qt$$

$$Qt=Mi\times Qi$$

Vt designates the electric potential of a toner image; VL designates an exposed surface potential of OPC; C designates per-area electrostatic capacity of OPC; and Qt designates the amount of toner per area. OPC is an abbreviation for a photosensitive drum (Organic Photo-Conductor)

Shortly, Mi×Qi in Equation (3) is taken as (Vti−VL)×C (Vti: Surface potential of a developing agent image Di), whereby the majority of surface potential required after elimination of electrostatic is derived. The grid potential becomes lower than or equal to the surface potential.

Moreover, since (the electric potential of the toner image before being subjected to static elimination)≈(development bias), Mi×Qi in Equation (3) is taken as (Vbi−VL)×C (Vbi: a development bias of developing color Ci), and Qmi<Qs can be conceived. Further, static elimination is understood to be unnecessary at a certain development bias or less. In the first place, if there stands a relationship (a development bias)≈(the electric potential of a toner image before undergoing static eliminating)≦(a grid potential), activation of the static eliminating device is useless.

The thus-formed "+" (positively)-charged toner image was transferred onto the surface of the recording sheet P that is placed on the surface of the sheet transport belt and is to be transported. As mentioned previously, transfer of the toner image was electrostatically performed by the transfer roller 64M to which a − (negative) transfer bias is applied.

Next, the recording sheet P, on which magenta toner had been transferred, was transported by the sheet transport belt 71, and came into contact with the photosensitive drum 51C for cyan toner, which is the second color. As in the case of magenta toner, a cyan toner image was transferred onto the recording sheet P on which magenta toner had already been transferred. Specifically, the cyan toner image was electrostatically transferred from the photosensitive drum 51C to the recording sheet P by means of a transfer bias and an opposing transfer roller 64C.

As in the case of magenta and cyan, a toner image of the third color (yellow) and a toner image of the fourth color (black) were also sequentially transferred onto the recording sheet P. Finally, a multicolor image formed from toner images formed on the recording sheet P in respective colors was fused onto the recording sheet P by the fusing section 5 and discharged to the sheet output tray 87.

As has been described above, the per-unit-area required transfer electric charge level Qmin is set so as to become smaller than the transfer prevention per-unit-area electric charge level Qs, and the transfer current flowing through the transfer roller 64 is set such that the supplied transfer electric charge level Qt fulfilling Equation (5) is supplied. Hence, the toner image on the photosensitive drum 51 can be transferred to the recording sheet P without involvement of occurrence of reverse transfer.

When the quantity-of-developing-agent-per-unit-area-on-transfer-member Md has been determined, the transfer prevention per-unit-area electric charge level Qs is determined in accordance with the value of the quantity-of-developing-agent-per-unit-area-on-transfer-member Md. The designer of the printer 1 can readily estimate the transfer prevention per-unit-area electric charge level Qs for preventing reverse transfer.

The per-unit-area required transfer electric charge level Qmin is expressed by Equation (4). Hence, even when the maximum weight of transferred toner image per unit area for respective developing agents of colors (M1 to M4) and the quantities of electrostatic per unit weight (Q1 to Q4) for respective developing agents of colors are different from each other, there can be performed processing fulfilling the reverse transfer prevention relational expression in accordance with the maximum weight of transferred toner image per unit area for respective developing agents of colors and the quantities of electrostatic per unit weight for respective developing agents of colors.

When printing a predetermined number of copies has been performed after replacement of toner, operation of the static eliminating device 55 is disabled. Therefore, when the reverse transfer prevention relational expression is fulfilled without operation of the static eliminating device 55, useless operation of the static eliminating device 55 can be eliminated.

The printer 1 adopts a cleanerless system. However, as a result of prevention of reverse transfer, mixing of colors of toner stored in the development unit 54 can be suppressed.

Since toner assumes an essentially spherical shape, physical adhesion (van der Waals force or the like) becomes smaller. Specifically, the amount of toner adhering from the recording sheet P to the photosensitive drum 51 becomes smaller. Therefore, the amount of toner reversely transferred from the recording sheet P to the photosensitive drum 51 can be suppressed further.

In the above-described illustrative aspect, the color laser printer 1 corresponds to an image forming apparatus. The photosensitive drums 51M, 51C, 51Y, and 51K correspond to image carriers. The electrifying devices 52M, 52C, 52Y, and 52K correspond to an electrifying unit; the exposure devices 53M, 53C, 53Y, and 53K correspond to an exposure unit; and the development units 54M, 54C, 54Y, and 54K correspond to a development unit. The transport section 42 corresponds to a transport mechanism. The transfer rollers 64M, 64C, 64Y, and 64K correspond to a transfer unit. The static eliminating devices 55M, 55C, 55Y, and 55K correspond to a static eliminating unit. The static eliminating device operation determination processing in FIG. 5 corresponds to the static eliminating unit disabling unit of the present invention. The recording sheet P corresponds to a transferred member.

Second Illustrative Aspect

A second illustrative aspect will be described hereinbelow by reference to the drawings. In the second illustrative aspect, only those elements which differ from those of the first illustrative aspect are described.

Figure 8:
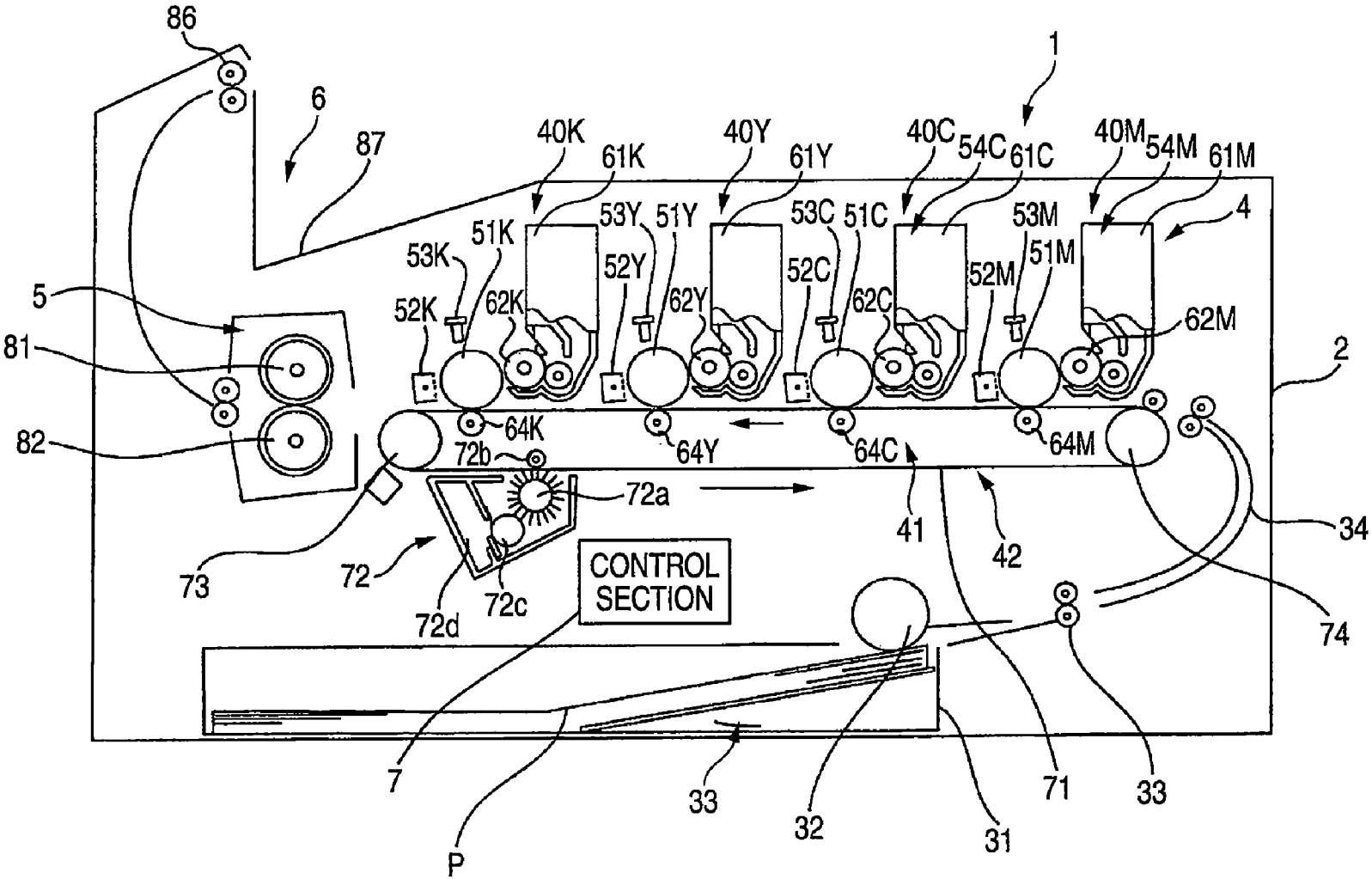
FIG. 8 is a side cross-sectional view showing the diagrammatic configuration of a color laser printer of a second illustrative aspect.

First, the configuration of the printer 1 according to the second illustrative aspect will be described by reference to FIG. 8. FIG. 8 is a side cross-sectional view showing the basic configuration of the printer 1 of the second illustrative aspect.

As shown in FIG. 8, the configuration of the printer 1 of the second illustrative aspect is identical with that of the printer 1 of the first illustrative aspect except that the static eliminating devices 55M, 55C, 55Y, and 55K are omitted.

Processing to be executed by the CPU 91 of the control section 7 is now described. Processing differs from that of the first illustrative aspect in that image data generation processing has been changed and that static eliminating device operation determination processing is omitted.

Here, image data generation processing of the second illustrative aspect differs from that of the first illustrative aspect in connection with processing pertaining to S10. In order to fulfill the reverse transfer prevention relational expression, the area of pixels where toner layers of a plurality of colors overlap each other is made smaller than that in the first illustrative aspect [e.g., pixel E5 in FIG. 7A], to thus generate image data for exposure purpose.

Namely, since the static eliminating devices 55M, 55C, 55Y, and 55K are omitted from the printer 1 of the second illustrative aspect, the reverse transfer prevention relational expression is not fulfilled until printing of a predetermined number of copies or more is performed after replacement of toner. For this reason, the print area of one pixel is reduced, to thus decrease the transfer prevention per-unit-area electric charge level Qs, thereby fulfilling the reverse transfer prevention relational expression. The reason for this is that the smaller the area of one pixel, the smaller the quantity-of-developing-agent-per-unit-area-on-transfer-member Md.

Specific numerical values are represented by fourth to sixth examples provided below, thereby providing an explanation of reducing the quantity-of-developing-agent-per-unit-area-on-transfer-member Md to thus fulfill the reverse transfer prevention relational expression.

First, the basic print conditions common among the fourth to sixth examples are printed on the recording sheet P in such a way that magenta (M) toner and yellow (Y) toner are printed on the recording sheet P so as to become equal to each other in terms of the amount of adhering toner. Subsequently, black (K) toner is printed on the recording sheet P.

The amount of electric charge of magenta (M) toner per unit weight and the amount of electric charge of yellow (Y) toner per unit weight are assumed to take on a value of 0.050 μC/mg.

The value of the reverse transfer prevention relational expression achieved during printing of black (K) toner is provided.

FOURTH EXAMPLE

When the quantity-of-developing-agent-per-unit-area-on-transfer-member Md assumes a value of 1.2 mg/cm$^2$ [i.e., 0.6 mg/cm$^2$ of magenta (M) toner and 0.6 mg/cm$^2$ of yellow (Y) toner are printed], the per-unit-area required transfer electric charge level Qmin=0.12 (μC/cm$^2$) is computed as in the case of the first example.

As in the case of the first example, a transfer prevention per-unit-area electric charge level Qs=0.047 (μC/m$^2$) is computed. Accordingly, a relationship of Qmin>Qs is derived. In short, the reverse transfer prevention relational expression is not fulfilled.

FIFTH EXAMPLE

When the quantity-of-developing-agent-per-unit-area-on-transfer-member Md in the area where an overlap exists between magenta (M) toner and yellow (Y) toner is 0.744 mg/cm$^2$ [i.e., 62% of the quantity-of-developing-agent-per-unit-area-on-transfer-member Md achieved in Specific Example 4 and 0.372 mg/cm$^2$ of magenta (M) toner and 0.372 mg/cm$^2$ of yellow (Y) toner are printed, respectively], there is a necessity for effecting printing in an area where no overlap exists between magenta (M) toner and yellow (Y) toner, without changing the developing agent quantity on per-unit-area-of-transfer-member Md (i.e., with 100% of quantity-of-developing-agent-per-unit-area-on-transfer-member Md in the fourth example). Hence, the per-unit-area required transfer electric charge level Qmin remains unchanged. Specifically, as in the case of the fourth example, there is obtained Qmin=0.12 [μC/cm$^2$].

The transfer prevention per-unit-area electric charge level Qs is computed as Qs=0.068/(0.744)$^2$=0.122 (μC/cm$^2$) Accordingly, there is derived Qmin(=0.12)<Qs(=0.122). In short, the reverse transfer prevention relational expression is fulfilled.

SIXTH EXAMPLE

An area, where magenta (M) toner and yellow (Y) toner overlap each other, assumes a quantity-of-developing-agent-per-unit-area-on-transfer-member Md of 0.6 mg/cm$^2$ [i.e., 50% of the quantity-of-developing-agent-per-unit-area-on-transfer-member Md achieved in Specific Example 4 and 0.3 mg/cm$^2$ of magenta (M) toner and 0.3 mg/cm$^2$ of yellow (Y) toner are printed, respectively], the per-unit-area required transfer electric charge level Qmin assumes a value of Qmin=0.12 [μC/cm$^2$], as in the case of the fifth example.

The transfer prevention per-unit-area electric charge level Qs is computed as Qs=0.068/(0.6)$^2$=0.189 (μC/cm$^2$).

Accordingly, there is derived Qmin<Qs. In short, the reverse transfer prevention relational expression is fulfilled.

In the above-described fifth and sixth examples, the reverse transfer prevention relational expression can be fulfilled by means of reducing the quantity-of-developing-agent-per-unit-area-on-transfer-member Md to a value of 0.744 mg/cm$^2$ or less.

In the printer 1 of the second illustrative aspect configured as mentioned above, the unit of the per-unit-area required transfer electric charge level Qmin is smaller than the transfer prevention per-unit-area electric charge level Qs. Since the transfer current flowing through the transfer roller 64 is set such that the supplied transfer electric charge level Qt satisfying Equation (5) is supplied, the toner image on the photosensitive drum 51 can be transferred to the recording sheet P without inducing reverse transfer.

In the above-described illustrative aspect, image data generation processing in FIG. 4 corresponds to image processing unit, and image data for exposure correspond to image data.

The two illustrative aspects have been described thus far. However, the present invention is not limited to the above-described illustrative aspects. Various modes falling within the technical scope of the present invention Can be adopted.

For instance, the above illustrative aspects illustrate a tandem color laser printer of direct transfer type which transfers toner images from the respective photosensitive drums 51 directly to the recording sheet P. However, the present invention is not limited to this printer. The present invention may be configured as a tandem color laser printer of intermediate transfer type, where toner images of respective colors are transferred from respective photosensitive drums to an intermediate transfer belt serving as a transferred member, and the toner images are collectively transferred onto a recording sheet.

The present invention is not limited to a tandem color laser printer, but may be configured as, for instance, a so-called four cycle color laser printer, where toner images of respective colors are sequentially formed on one photosensitive drum common among development units of respective colors; and where the toner images are then sequentially superposed on the transferred member, such as a recording sheet or an intermediate transfer belt, to thus form a multicolor toner image on the transferred member.

The illustrative aspect has illustrated the image forming apparatus where a transfer bias is applied to the transfer roller 64 by means of constant current control. However, the transfer bias may be applied by means of constant voltage control.

In the present illustrative aspect, when a predetermined number of copies or more have been copied, operation of the static eliminator is disabled. However, when the development bias, which has been achieved when density correction is made, has become lower than the grid potential or less, operation of the static eliminators may be disabled.

The second illustrative aspect has illustrated the image forming apparatus from which the electrostatic eliminating devices 55 and electrostatic eliminating device operation determination processing are omitted. However, in the second illustrative aspect, the electrostatic eliminating devices 55 maybe added, to thus cause the control section 7 to perform static eliminating device operation determination processing.

As described above in detail with reference to the illustrative aspects, there is provided an image forming apparatus including: an image carrier that is to be formed thereon an electrostatic latent image; an electrifying unit that electrifies a surface of the image carrier to a predetermined polarity; an exposure unit that exposes the surface of the image carrier electrified by the electrifying unit, in accordance with image data to form an electrostatic latent image; a development unit that develops the electrostatic latent image formed by the exposure unit with one of developing agents of a plurality of colors to form a developing agent image on the image carrier; a transport mechanism that transports a transferred member to be in contact with the image carrier, the transferred member being transferred to be formed thereon the developing agent image; and a transfer unit that transfers the developing agent image formed on the image carrier to the transferred member transported by the transport mechanism by applying transfer electric charges having polarity opposite an electrified polarity of the developing agent from a surface of the transferred member opposite a surface thereof opposing the image carrier. Te transfer unit forms a multicolor developing agent image on the transferred member by sequentially transferring the developing agent images of respective colors made from a plurality of the developing agents on the transferred member while the transport mechanism sequentially transporting the transferred member. When: among developing agent images of a plurality of colors to be transferred, a developing agent having already been transferred onto the transferred member is taken as a transferred developing agent image; and the maximum amount of transfer electric charge per unit area, at which reverse transfer of the transferred developing agent image onto the image carrier is prevented when a developing agent image of another color is transferred to the transferred member on which the transferred developing agent image is formed from developing agents of some colors of developing agents of a plurality of colors to be transferred, is taken as an amount of prevention per-unit-area transfer electric charge, an amount of required unit area transfer electric charge, which is an amount of transfer electric charge per unit area required by the transfer unit to transfer to the transferred member the maximum weight of developing agent image formed on the image carrier, becomes smaller than the weight of a prevention unit area transfer electric charge which is determined on the basis of an amount of developing agent per unit area on the transferred member that is the maximum weight of transferred developing agent image per unit area of achieved immediately before the transferred developing agent image is transferred by the transfer unit.

According to the image forming apparatus having the above configuration, the amount of required unit area transfer electric charge is smaller than the weight of a prevention unit area transfer electric charge, and hence all developing agent images on the image carrier can be transferred to the transfer section without inducing reverse transfer.

The inventor of the present invention has newly found that the weight of prevention unit area transfer electric charge is dependent on the amount of developing agent per unit area on the transferred member. In the image forming apparatus, the amount of required unit area transfer electric charge becomes smaller and the amount of developing agent per unit area on the transferred member is set such that the amount of required unit area transfer electric charge becomes smaller than the weight of prevention unit area transfer electric charge.

Specifically, when the amount of developing agent per unit area on the transferred member has been determined, the amount of prevention unit area transfer electric charges is determined in accordance with the value of the amount of developing agent per unit area on the transferred member. Therefore, the designer of the image forming apparatus of the present invention can more easily estimate of the amount of prevention unit area transfer electric charge used for preventing occurrence of reverse transfer.

More specifically, the image forming apparatus of the present invention is configured that, on condition that: the amount of required unit area transfer electric charge is taken as Qmin; the amount of prevention per-unit-area transfer electric charge is taken as Qs; the amount of developing agent per unit area on the transferred member is taken as Md; and a predetermined constant used for expressing a relationship between the amount of prevention per-unit-area transfer electric charge Qs and the amount of developing agent per unit area on the transferred member Md is taken as "a", a reverse transfer prevention relational expression, which is a relational expression for preventing reverse transfer, is represented by Equation (1) shown below, and the amount of prevention per-unit-area transfer electric charge is represented by Equation (2) shown below, and wherein the image forming apparatus is configured to fulfill the reverse transfer prevention relational expression represented by the Equation (1).

$$Qmin<Qs \quad (1)$$

$$Qs=a/(Md)^2 \quad (2)$$

The present inventors have found that the amount of prevention per-unit-area transfer electric charge is inversely proportional to a square of the amount of developing agent per unit area on the transferred member Md.

Therefore, in the image forming apparatus, on condition that: an amount of developing agent per unit area on an arbitrary transferred member is taken as Mo; and an amount of prevention per-unit-area transfer electric charge in the amount of developing agent per unit area on an arbitrary transferred member Mo is taken as Qo, the constant is defined by the equation shown below.

$$a = Qo \times (Mo)^2$$

Now, on condition that a unit of the amount of required unit area transfer electric charge is taken as ($C/m^2$) and that a unit of the amount of developing agent per unit area on an arbitrary transferred member is taken as ($g/m^2$), the constant is 0.068.

The image forming apparatus may be configured that the image forming apparatus is formed so as to form developing agent images of "n" colors ("n" is an integer of 2 or more) on the transferred member, wherein in order to distinguish the developing agent images of "n" colors from each other, an integer "i" ("i"=1 to "n") is suffixed to each of the colors of developing agents, to thus acquire developing agent colors Ci; developing agent images of the developing agent colors Ci are taken as developing agent images Di; the maximum weight of the developing agent image Di transferred to the transferred member per unit area is taken as Mi ("i"=1 to "n"); and an amount of electric charge per unit weight in the developing agent image Di transferred to the transferred member is taken as Qi ("i"=1 to "n"), wherein the amount of required unit area transfer electric charge is represented by Equation (3) shown below.

$$Q_{\min} = \sum_{i=1}^{n} Mi \times Qi \tag{3}$$

The amount of required unit area transfer electric charge (i.e., Mi×Qi) can be computed for each of the colors of the developing agents.

Therefore, according to the image forming apparatus thus configured, even when Mi and Qi change according to the color of the developing agent, processing for fulfilling the reverse transfer prevention relational expression can be performed in correspondence to Mi and Qi of each of the colors of the developing agents.

In order to fulfill the reverse transfer prevention relational expression, the image forming apparatus of the present invention may further include: a static eliminating unit that reduces an amount of electric charge of the developing agent image Di formed on the image carrier so as to fulfill the reverse transfer prevention relational expression before the developing agent image Di formed on the image carrier is transferred to the transferred member.

Further, the image forming apparatus may further include: a static eliminating disable unit that disables operation of the static eliminating unit when the amount of electric charge per unit weight in a developing agent of the developing agent color Ci is expected to fulfill the reverse transfer prevention relational expression after replacement of a developing agent of the developing agent color Ci has been performed (for instance, the image forming apparatus produces a previously-set, specified number of copies).

According to the image forming apparatus having the above mentioned configuration, when the reverse transfer prevention relational expression is fulfilled without activation of the static eliminating unit, useless activation of the static eliminating unit can be omitted. An excessive reduction in the amount of electrostatic charge can be avoided without fail.

In order to fulfill the reverse transfer prevention relational expression, the image forming apparatus may further include an image processing unit that generating the image data such that the amount of developing agent per unit area on the transferred member assumes a value fulfilling a relationship of the amount of required unit area transfer electric charge being smaller than the amount of prevention per-unit-area transfer electric charge.

For instance, image data may be generated such that the area of pixels forming the image data is scaled down, thereby diminishing the amount of prevention per-unit-area transfer electric charge.

Moreover, in a case where the development unit is configured to recover a developing agent remaining on a surface of the image carrier after the developing agent has been transferred by the transfer unit and to recycle the recovered developing agent for formation of a developing agent image on the image carrier (a so-called cleanerless system), when the transferred developing agent image is reversely transferred to the image carrier, the developing agent—which is different in color from the developing agents housed in the developing means—is recovered by the development unit, which may raise a problem of mixing of colors of the developing agents.

However, according to the image-forming apparatus, reverse transfer is prevented, and hence mixing of colors of the developing agents can be prevented while the cleanerless system is adopted.

Moreover, in the image forming apparatus according to the present invention, the developing agent is better to spherical toner.

Specifically, since the developing agent is substantially spherical toner, physical adhesion (van der Waals force or the like) is reduced. Specifically, the amount of toner adhering from the transferred member to the image carrier becomes smaller. For this reason, the amount of the transferred developing agent image that is reversely-transferred from the transferred member to the image carrier can be suppressed.

The foregoing description of the illustrative aspects has been presented for purposes of illustration and description. It is not intended to be exhaustive or to limit the invention to the precise form disclosed, and modifications and variations are possible in light of the above teachings or may be acquired from practice of the invention. The illustrative aspects were chosen and described in order to explain the principles of the invention and its practical application program to enable one skilled in the art to utilize the invention in various illustrative aspects and with various modifications as are suited to the particular use contemplated. It is intended that the scope of the invention be defined by the claims appended hereto, and their equivalents.

What is claimed is:

1. An image forming apparatus comprising:

an image carrier that is to be formed thereon an electrostatic latent image;

an electrifying unit that electrifies a surface of the image carrier to a predetermined polarity;

an exposure unit that exposes the surface of the image carrier electrified by the electrifying unit, in accordance with image data to form an electrostatic latent image;

a development unit that develops the electrostatic latent image formed by the exposure unit with one of developing agents of a plurality of colors to form a developing agent image on the image carrier;

a transport mechanism that transports a transferred member to be in contact with the image carrier, the transferred member being transferred to have the developing agent image formed thereon; and a transfer unit that transfers the developing agent image formed on the image carrier to the transferred member transported by the transport mechanism by applying transfer electric charges having polarity opposite an electrified polarity of the developing agent from a surface of the transferred member opposite a surface thereof opposing the image carrier, wherein the transfer unit forms a multicolor developing agent image on the transferred member by sequentially transferring the developing agent images of respective colors made from a plurality of the developing agents on the transferred member while the transport mechanism sequentially transporting the transferred member, wherein when:

among developing agent images of a plurality of colors to be transferred, a developing agent having already been transferred onto the transferred member is taken as a transferred developing agent image; and the maximum amount of transfer electric charge per unit area, at which reverse transfer of the transferred developing agent image onto the image carrier is prevented when a developing agent image of another color is transferred to the transferred member on which the transferred developing agent image is formed from developing agents of some colors of developing agents of a plurality of colors to be transferred, is taken as an amount of prevention per-unit-area transfer electric charge, an amount of required unit area transfer electric charge, which is an amount of transfer electric charge per unit area required by the transfer unit to transfer to the transferred member the maximum weight of developing agent image formed on the image carrier, is less than an amount of a prevention unit area transfer electric charge which is determined on the basis of an amount of developing agent per unit area on the transferred member that is the maximum weight of transferred developing agent image per unit area immediately before the transferred developing agent image is transferred by the transfer unit, wherein on condition that: the amount of required unit area transfer electric charge is taken as Qmin; the amount of prevention per-unit-area transfer electric charge is taken as Qs; the amount of developing agent per unit area on the transferred member is taken as Md; and a predetermined constant used for expressing a relationship between the amount of prevention per-unit-area transfer electric charge Qs and the amount of developing agent per unit area on the transferred member Md is taken as "a", a reverse transfer prevention relational expression, which is a relational expression for preventing reverse transfer, is represented by Equation (1) shown below, and the amount of prevention per-unit-area transfer electric charge is represented by Equation (2) shown below, and wherein the image forming apparatus is configured to fulfill the reverse transfer prevention relational expression represented by the Equation (1), $$Qmin<Qs \quad (1)$$

$$Qs=a/(Md)^2 \quad (2).$$

2. The image forming apparatus according to claim 1, wherein on condition that: an amount of developing agent per unit area on an arbitrary transferred member is taken as Mo; and an amount of prevention per-unit-area transfer electric charge in the amount of developing agent per unit area on an arbitrary transferred member Mo is taken as Qo, the constant is defined by the equation shown below, $$a=Qo\times(Mo)^2.$$

3. The image forming apparatus according to claim 1, wherein on condition that: a unit of the amount of required unit area transfer electric charge is taken as ($C/m^2$); and a unit of the amount of developing agent per unit area on an arbitrary transferred member is taken as ($g/m^2$), the constant is 0.068.

4. The image forming apparatus according to claim 1, wherein the image forming apparatus is formed so as to form developing agent images of "n" colors ("n" is an integer of 2 or more) on the transferred member, wherein in order to distinguish the developing agent images of "n" colors from each other, an integer "i" ("i"=1 to "n") is suffixed to each of the colors of developing agents, to thus acquire developing agent colors Ci; developing agent images of the developing agent colors Ci are taken as developing agent images Di; the maximum weight of the developing agent image Di transferred to the transferred member per unit area is taken as Mi ("i"=1 to "n"); and an amount of electric charge per unit weight in the developing agent image Di transferred to the transferred member is taken as Qi ("i"=1 to "n"), wherein the amount of required unit area transfer electric charge is represented by Equation (3) shown below, $$Q_{\min}=\sum_{i=1}^{n} Mi\times Qi \quad (3)$$

5. The image forming apparatus according to claim 4, further comprising a static eliminating unit that reduces an amount of electric charge of the developing agent image Di formed on the image cater so as to fulfill the reverse transfer prevention relational expression before the developing agent image Di formed on the image cater is transferred to the transferred member.

6. The image forming apparatus according to claim 5, further comprising: a static eliminating disable unit that disables operation of the static eliminating unit when the amount of electric charge per unit weight in a developing agent of the developing agent color Ci is expected to fulfill the reverse transfer prevention relational expression after replacement of a developing agent of the developing agent color Ci has been performed.

7. The image forming apparatus according to claim 1, further comprising an image processing unit that generates the image data such that the amount of developing agent per unit area on the transferred member assumes a value fulfilling a relationship of the amount of required unit area transfer electric charge being smaller than the amount of prevention per-unit-area transfer electric charge.

8. The image forming apparatus according to claim 1, wherein the development unit recovers a developing agent remaining on a surface of the image carrier after the developing agent has been transferred by the transfer unit, and recycles the recovered developing agent for formation of a developing agent image on the image carrier.

9. The image forming apparatus according to claim 1, wherein the developing agent is substantially spherical toner.

10. The image forming apparatus according to claim 1, wherein the developing agent is polymer toner.

* * * * *